US007194867B2

(12) United States Patent
Bartlett et al.

(10) Patent No.: US 7,194,867 B2
(45) Date of Patent: Mar. 27, 2007

(54) INTEGRATED ROUGH/PURGE/VENT (RPV) VALVE

(75) Inventors: Allen J. Bartlett, Mondon, MA (US); Gary S. Ash, Dartmouth, MA (US); Brian Thompson, Lakeville, MA (US); Mark A. Stira, Wilmington, MA (US)

(73) Assignee: Brooks Automation, Inc., Chelmsford, MA (US)

( * ) Notice: Subject to any disclaimer, the term of this patent is extended or adjusted under 35 U.S.C. 154(b) by 323 days.

(21) Appl. No.: 10/804,842

(22) Filed: Mar. 19, 2004

(65) Prior Publication Data

US 2005/0204753 A1 Sep. 22, 2005

(51) Int. Cl.
*B01D 8/00* (2006.01)

(52) U.S. Cl. ..... 62/55.5

(58) Field of Classification Search ..... 62/55.5
See application file for complete search history.

(56) References Cited

U.S. PATENT DOCUMENTS

| | | | | |
|---|---|---|---|---|
| 3,335,550 | A * | 8/1967 | Stern | 96/144 |
| 4,117,694 | A | 10/1978 | Belmore | |
| 4,697,617 | A | 10/1987 | Bourke et al. | |
| 4,719,938 | A | 1/1988 | Pandorf | |
| 4,799,359 | A | 1/1989 | Nicoll | |
| 4,834,136 | A | 5/1989 | Bourke et al. | |
| 5,009,073 | A * | 4/1991 | Missimer et al. | 62/51.1 |
| 5,137,050 | A | 8/1992 | Clarke et al. | |
| 5,242,277 | A | 9/1993 | Bartlett | |
| 5,333,466 | A * | 8/1994 | Harrington et al. | 62/55.5 |
| 5,356,270 | A | 10/1994 | Bartlett | |
| 5,465,584 | A * | 11/1995 | Mattern-Klosson et al. | 62/55.5 |
| 5,517,823 | A | 5/1996 | Andeen et al. | |
| 5,862,671 | A * | 1/1999 | Lessard et al. | 62/55.5 |
| 5,901,558 | A | 5/1999 | Matté et al. | |
| 5,974,809 | A | 11/1999 | Wooster et al. | |

FOREIGN PATENT DOCUMENTS

| | | |
|---|---|---|
| EP | 0 466 776 B1 | 1/1994 |
| EP | 0 236 018 | 10/1994 |
| WO | WO 90/12231 A1 | 10/1990 |
| WO | WO 97/39242 A1 | 10/1997 |

* cited by examiner

*Primary Examiner*—William C. Doerrler
(74) *Attorney, Agent, or Firm*—Hamilton, Brook, Smith & Reynolds, P.C.

(57) ABSTRACT

A single ducted valve assembly provides an integrated cryopump valve having a purge valve port connecting the assembly to a cryopump with a coaxial connection having an inner duct and an outer duct. A pressurized gas interface connects a pressurized gas source to the cryopump through the inner duct. A rough valve port can connect the outer duct of the assembly to a rough vacuum pump; and a relief valve port can connect the outer duct of the assembly to an exhaust stack.

23 Claims, 4 Drawing Sheets

INTEGRATED ROUGH/PURGE/VENT (RPV) VALVE

BACKGROUND OF THE INVENTION

Currently available cryogenic vacuum pumps, or cryopumps, generally follow a common design concept. A low temperature array, usually operating in the range of 4 to 25K, is the primary pumping surface. This surface is surrounded by a higher temperature radiation shield, usually operated in the temperature range of 60 to 130K, which provides radiation shielding to the lower temperature array. The radiation shield generally comprises a housing which is closed except at a frontal array positioned between the primary pumping surface and a work chamber to be evacuated.

In operation, high boiling point gases such as water vapor are condensed on the frontal array. Lower boiling point gases pass through that array and into the volume within the radiation shield and condense on the lower temperature array. A surface coated with an adsorbent such as charcoal or a molecular sieve operating at or below the temperature of the colder array may also be provided in this volume to remove the very low boiling point gases such as hydrogen. With the gases thus condensed and/or adsorbed onto the pumping surfaces, only a vacuum remains in the work chamber.

In systems cooled by closed cycle coolers, the cooler is typically a two-stage refrigerator having a cold finger which extends through the rear side of the radiation shield. High pressure helium refrigerant is generally delivered to the cryocooler through high pressure lines from a compressor assembly. Electrical power to a displacer drive motor in the cooler is usually also delivered through the compressor.

The cold end of the second, coldest stage of the cryocooler is at the tip of the cold finger. The primary pumping surface, or cryopanel, is connected to a heat sink at the coldest end of the second stage of the cold finger. This cryopanel may be a simple metal plate or cup or an array of metal baffles arranged around and connected to the second stage heat sink. This second-stage cryopanel also supports the low temperature adsorbent.

The radiation shield is connected to a heat sink, or heat station, at the coldest end of the first stage of the refrigerator. The shield surrounds the second-stage cryopanel in such a way as to protect it from radiant heat. The frontal array is cooled by the first-stage heat sink through the side shield or, as disclosed in U.S. Pat. No. 4,356,701, through thermal struts.

After several days or weeks of use, the gases which have condensed onto the cryopanels, and in particular the gases which are adsorbed, begin to saturate the cryopump. A regeneration procedure must then be followed to warm the cryopump and thus release the gases and remove the gases from the system. As the gases evaporate, the pressure in the cryopump increases, and the gases are exhausted through a relief valve. During regeneration, the cryopump is often purged with warm nitrogen gas. The nitrogen gas hastens warming of the cryopanels and also serves to flush water and other vapors from the cryopump. By directing the nitrogen into the system close to the second-stage array, the nitrogen gas which flows outward to the exhaust port minimizes the movement of water vapor from the first array back to the second-stage array. Nitrogen is the usual purge gas because it is inert and is available free of water vapor. It is usually delivered from a nitrogen storage bottle through a fluid line and a purge valve coupled to the cryopump.

After the cryopump is purged, it must be rough pumped to produce a vacuum about the cryopumping surfaces and cold finger to reduce heat transfer by gas conduction and thus enable the cryocooler to cool to normal operating temperatures. The rough pump is generally a mechanical pump coupled through a fluid line to a roughing valve mounted to the cryopump.

Control of the regeneration process is facilitated by temperature sensors coupled to the cold finger heat stations. Thermocouple pressure gauges have also been used with cryopumps. Although regeneration may be controlled by manually turning the cryocooler off and on and manually controlling the purge and roughing valves, a separate regeneration controller is used in more sophisticated systems. Wires from the controller are coupled to each of the sensors, the cryocooler motor and the valves to be actuated. A cryopump having an integral electronic controller is presented in U.S. Pat. No. 4,918,930.

In a fast regeneration process, the second stage of the cryopump is heated as purge gas is applied to the cryopump. As the second stage of the cryopump is warmed, the gases trapped at the second stage are released and exhausted through a relief valve.

SUMMARY OF THE INVENTION

As discussed above, cryopumps have a plurality of valves for proper operation of the cryopumping system. A typical cryopump has a total of five valves: a pneumatic rough valve, a rough pilot valve, a pump purge valve, an exhaust purge valve, and a pressure relief valve. In preexisting systems, the pneumatic rough valve and the rough pilot valve are integrated to make a single assembly. The other three valves are separate parts, requiring as a many as three vacuum flanges or ports as mounting points, and as many as three connection points for either pressurized nitrogen or compressed air to pilot or actuate the valves.

Using internal spaces in a formed assembly, a single penetration into a cryopump volume can be achieved through the use of a coaxial connection wherein the inner tube is used for supplying purge gas to the cryopump, while the outer part is used for exhaust. For example, the exhaust could be either a rough valve or a relief valve.

Further the internal spaces in the assembly can duct pressurized gas, such as nitrogen or compressed air, to all the places where it is needed in order to eliminate the need for a distribution node, thus reducing the number of hose connections.

A single ducted valve assembly provides an integrated cryopump valve having a purge valve connecting the assembly to a cryopump with a coaxial connection having an inner duct and an outer duct. A pressurized gas interface connects a pressurized purge gas source to the cryopump through the inner duct. A rough valve can connect the outer duct of the assembly to a rough vacuum pump, and a relief valve can connect the outer duct of the assembly to an exhaust stack.

Some implementations use compressed air to actuate the rough pilot valve, while an embodiment of present invention uses pressurized nitrogen that is also used as the purge gas. This change is available as the assembly has a direct nitrogen supply available, and using this for valve actuation represents negligible extra load on the nitrogen supply. Further, to eliminate additional penetrations in the main vacuum housing, the assembly can also include a mounting point for a thermocouple gauge that may be used to measure the pressure in the cryopump volume.

BRIEF DESCRIPTION OF THE DRAWINGS

The foregoing and other objects, features and advantages of the invention will be apparent from the following more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION OF THE INVENTION

A description of preferred embodiments of the invention follows.

Figure 1:
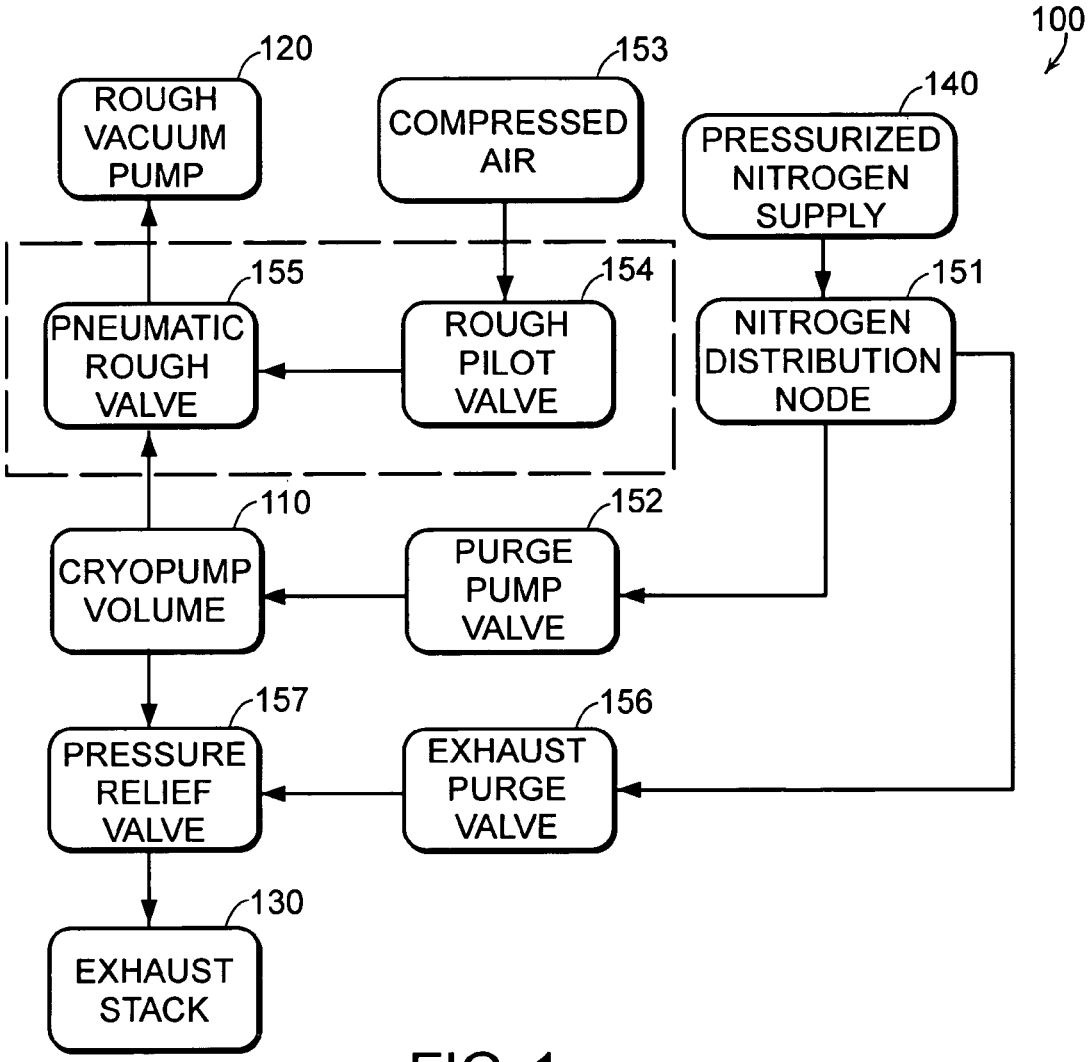
FIG. 1 PRIOR ART
FIG. 1 is a logical representation of a typical valve architecture of the prior art.

FIG. 1 is a diagram of a typical cryopumping system 100 in the prior art. In a physical representation of that system, the pneumatic rough valve 155 and the rough pilot valve 154 are integrated to make a single assembly. This rough valve assembly connects the cryopump volume 110 with the rough vacuum pump 120. A solenoid actuated rough pilot valve 154 controls pressurized air to bias the pneumatic rough valve 155. In addition a solenoid actuated pump purge valve 152 connects directly to the cryopump volume 110 to supply purge gas 140 (typically pressurized nitrogen). The pressurized gas 140 is typically distributed through a distribution node 151 that also directs pressurized gas through a solenoid actuated exhaust purge valve 156. As gases evaporate, the pressure in the cryopump volume increases, and gases are exhausted through the pressure relief valve 157. Nitrogen directed through the exhaust purge valve 156 minimizes the freezing and collection of water vapor and other contaminants, and dilutes evaporated gases passing through the pressure relief valve 157 to the exhaust stack 130.

Figure 2:
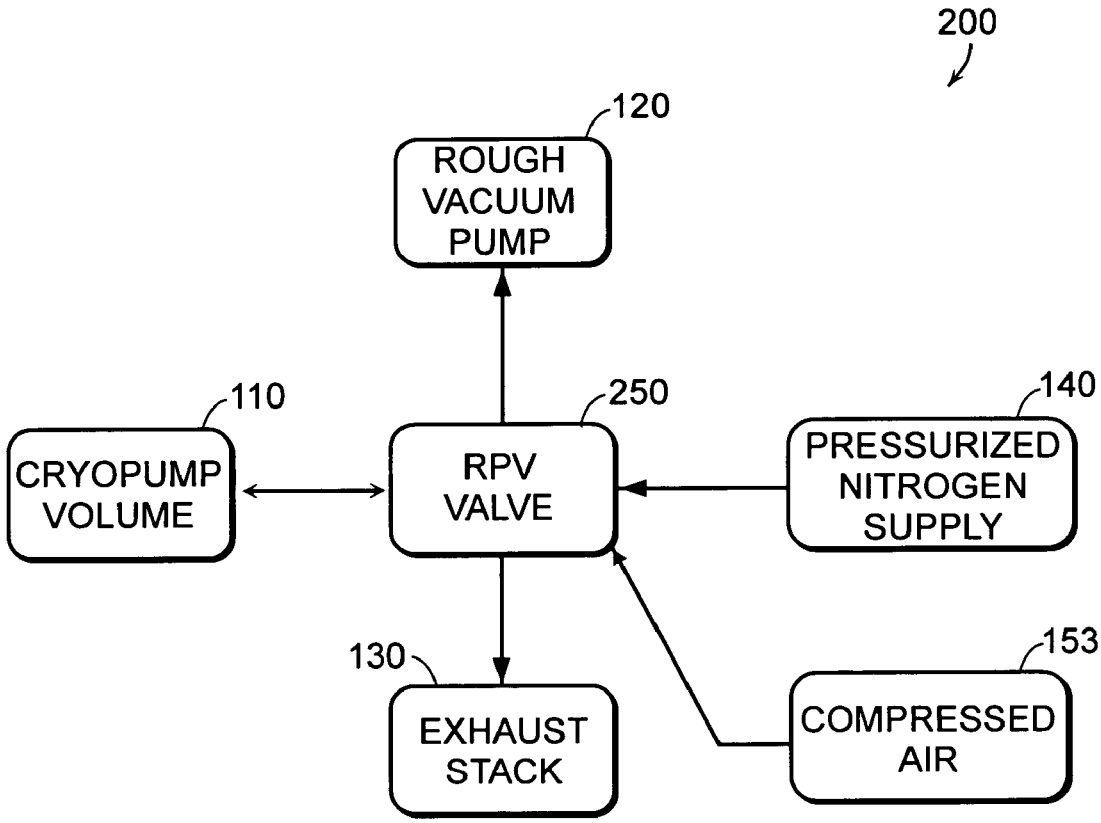
FIG. 2 is a logical representation of the integrated valve architecture of the present invention.

FIG. 2 is a logical representation of a cryopumping system 200 using an integrated rough/purge/vent (RPV) valve 250 of the present invention. The logical representation shows that a single multi-function valve 250 can be used to provide a single penetration into a cryopump volume 110. In addition the RPV valve 250 directly connects with the rough vacuum pump 120, and the exhaust stack 130, while receiving a pressurized nitrogen supply 140.

Figure 3:
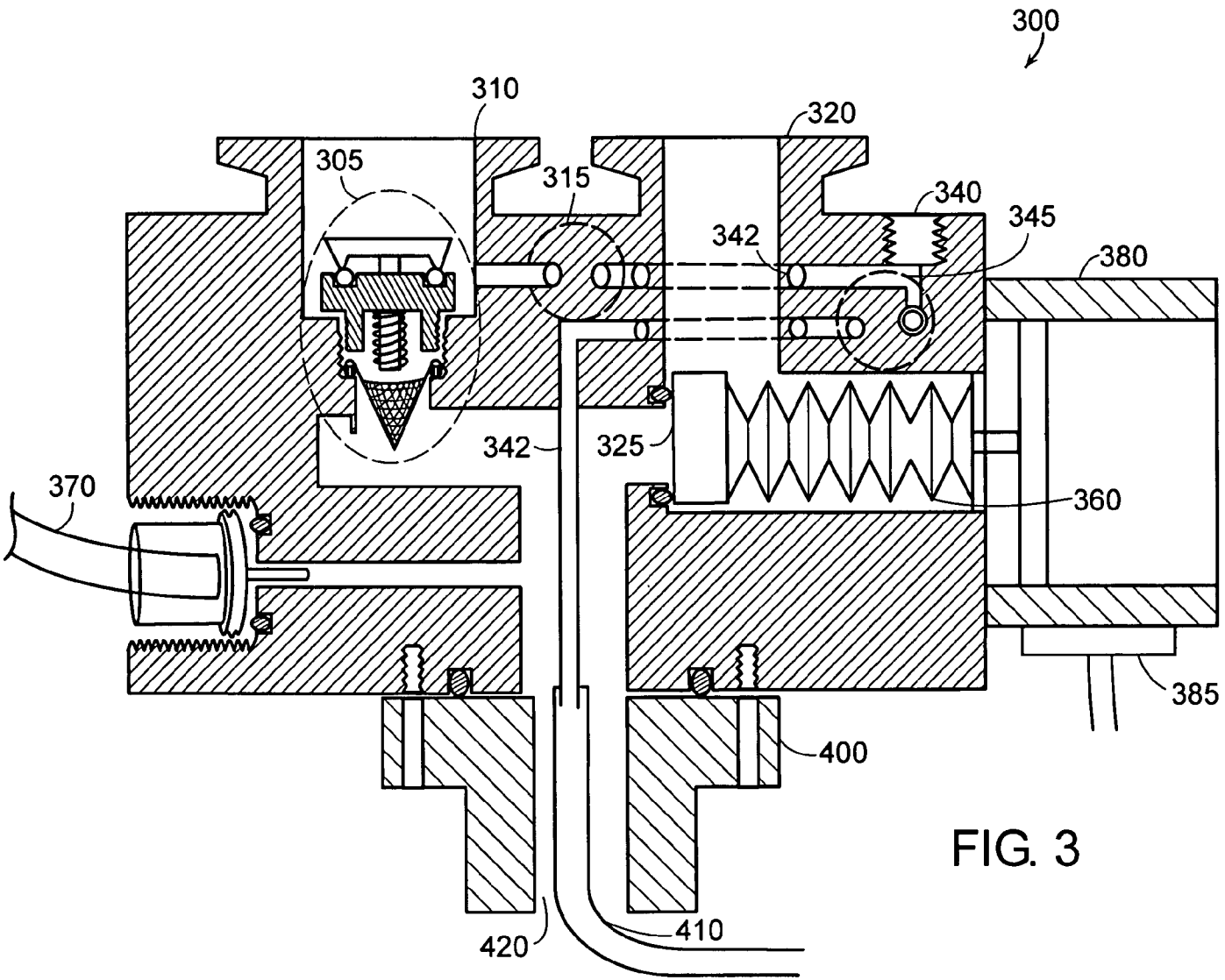
FIG. 3 is a sectional view of an embodiment of the present invention.

FIG. 3 shows an embodiment of the RPV valve 300 of the present invention having two exhausts. RPV valve 300 connects directly to a cryopump volume through a single pump purge valve port 400 that has a coaxial connection. To use a single penetration into the crypopump volume, a special provision is made to allow the rough pump to have good conductance to the entire volume of the pump, while the pump purge line ducts to the interior of the radiation shield of the crypopump volume. The present invention achieves this through the use of a coaxial connection 400.

Figure 4:
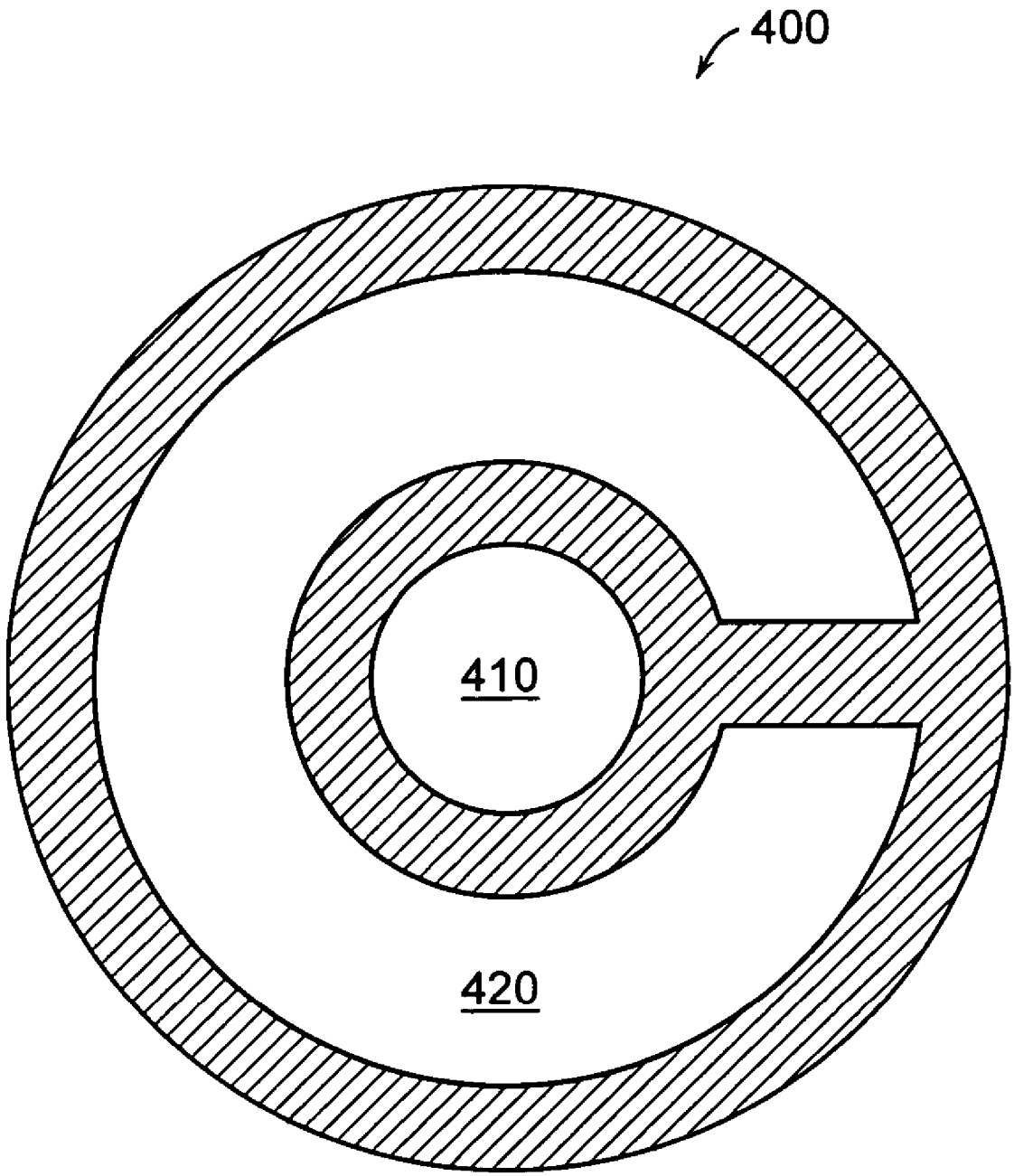
FIG. 4 is a plan view of the pump purge valve port as in FIG. 3 that connects to the cryopump volume with a coaxial connection.

The coaxial connection 400 has two ducts, an inner duct 410 and an outer duct 420. FIG. 4 provides a plan view of the coaxial connection. The inner duct connects into the cryopump by slipping into a purge gas line 610. The inner duct 410 supplies purge gas into the cryopump from the nitrogen supply connected at a pressurized gas interface 340. The pressurized nitrogen gas would also be directed through ducts within the assembly, such as passageway 342. Solenoids located on the valve assembly operate the exhaust purge valve 315 and purge valve 345 that control the flow of pressurized nitrogen gas through the inner passageways. In other embodiments of the present invention, the exhaust purge valve and the purge valve may be biased through the use of a pilot valve by pressurized gas, such as the pressurized nitrogen or pressurized air.

As shown in FIG. 3, the outer duct 420 provides a passage for gas from a cryopump volume to travel through a relief valve port 310 to exhaust stack 110 and also through rough valve port 320 to a rough vacuum pump 120.

The relief valve 305 controls the flow of gas out of the cryopump vacuum chamber through an exhaust stack or conduit. A relief valve 305 that may be used in the present invention is shown in FIG. 3. The relief valve includes a cap, which when the valve is closed, is held against an o-ring seal by a spring. If the pressure is sufficient to open the valve, the cap is pushed away from the o-ring seal and the exhausted gases flow past the seal. A cone shaped filter standpipe is mounted within the relief valve. The filter standpipe extends, from where it is mounted in the relief passage into the exhaust passage. U.S. Pat. No. 6,598,406, herein incorporated by reference, illustrates a relief valve having a cone shaped filter standpipe that may be used in connection with the present invention.

The rough valve 325 controls the flow of gas from the cryopump volume through rough vacuum pump. An actuator 380 can control the bias of the rough valve, through the moving spindle bellows 360. The spindle bellows 360 move the valve 325 within the confines of the outer duct through the use of pressurized air controlled through a solenoid 385. The movement of the rough valve 325 opens and closes access of the rough valve port to the cryopump volume.

This particular embodiment of the present invention also shows a port 370 that is provided to connect a thermocouple gauge for measuring the pressure in the cryopump volume.

While this invention has been particularly shown and described with references to preferred embodiments thereof, it will be understood by those skilled in the art that various changes in form and details may be made therein without departing from the scope of the invention encompassed by the appended claims.

What is claimed is:

1. A cryopump having a ducted integrated valve assembly, the valve assembly comprising:

a housing of the assembly having an interface to a cryopump;

a coaxial connection at the interface, connecting to an inner duct and an outer duct of the assembly;

an exhaust valve connecting the outer duct to an exhaust; and a purge valve connecting a pressurized gas source to the cryopump through the inner duct.

2. The cryopump of claim 1 wherein the exhaust valve is a rough valve connecting the outer duct of the assembly through the exhaust to a rough vacuum pump.

3. The cryopump of claim 1 wherein the exhaust valve is relief valve connecting the outer duct of the assembly through the exhaust to an exhaust stack.

4. The cryopump of claim 3 further comprising a rough valve connecting the outer duct of the assembly through an exhaust to a rough vacuum pump.

5. The cryopump of claim 3 further comprising an exhaust purge valve connecting a pressurized gas source to the exhaust stack.

6. The cryopump of claim 1 further comprising a pressure gauge in fluid communication with the outer duct of the assembly.

7. A cryopump having a ducted integrated valve assembly, the valve assembly comprising:

a housing of the assembly having an interface to a cryopump;

a coaxial connection at the interface, connecting to an inner duct and an outer duct of the assembly;

an exhaust valve connecting the outer duct to un exhaust; and a purge valve connecting a pressurized gas source to the cryopump through the inner duct wherein the pressurized gas source connects to control the biasing mechanisms of the purge valve and the exhaust valve.

8. The cryopump of claim 7 further comprising actuators to control the biasing of the purge valve and the exhaust valve.

9. The cryopump of claim 1 wherein the pressurized gas source is a nitrogen gas source.

10. The cryopump of claim 1 further comprising a pressure gauge in fluid communication with the outer duct.

11. A cryopump having a ducted integrated valve assembly, the valve assembly comprising:

a housing of the assembly having an interface to a cryopump;

a coaxial connection at the interface, connecting to an inner duct and an outer duct of the assembly;

a rough valve connecting the outer duct of the assembly to a rough vacuum pump;

a relief valve connecting the outer duct of the assembly to an exhaust stack;

an exhaust purge valve connecting a nitrogen gas source to the exhaust stack;

a purge valve connecting the nitrogen gas source to the cryopump through the inner duct;

actuators to control the biasing of the purge valve, rough valve and the exhaust purge valve; and a pressure gauge in fluid communication with the outer duct.

12. A cryopump having a ducted integrated valve assembly, the valve assembly comprising:

a housing having a single fluid duct;

a rough valve connecting the duct to a rough vacuum pump, and a relief valve connecting the duct to an exhaust stack.

13. A ducted valve assembly for providing an integrated cryopump valve comprising:

a housing of the assembly having an interface to a cryopump;

a coaxial connection at the interface, connecting to an inner duct and an outer duct of the assembly;

an exhaust valve connecting the outer duct to an exhaust; and a purge valve connecting a pressurized gas source to the cryopump through the inner duct.

14. The ducted valve assembly of claim 13 wherein the exhaust valve is a rough valve connecting the outer duct of the assembly through the exhaust to a rough vacuum pump.

15. The ducted valve assembly of claim 13 wherein the exhaust valve as relief valve connecting the outer duct of the assembly through the exhaust to an exhaust stack.

16. The ducted valve assembly of claim 15 further comprising a rough valve connecting the outer duct of the assembly through an exhaust to a rough vacuum pump.

17. The ducted valve assembly of claim 15 further comprising an exhaust purge valve connecting a pressurized gas source to the exhaust stack.

18. The ducted valve assembly of claim 13 further comprising a pressure gauge in fluid communication with the outer duct of the assembly.

19. A ducted valve assembly for providing an integrated cryopump valve comprising:

a housing of the assembly having an interface to a cryopump;

a coaxial connection at the interface, connecting to an inner duct and an outer duct of the assembly;

a exhaust valve connecting the outer duct to an exhaust; and a purge valve connecting a pressurized gas source to the cryopump through the inner duct wherein the pressurized gas source connects to control the biasing mechanisms of the purge valve and the exhaust valve.

20. The ducted valve assembly of claim 19 further comprising actuators to control the biasing of the purge valve and the exhaust valve.

21. The ducted valve assembly of claim 13 wherein the pressurized gas source is a nitrogen gas source.

22. The ducted valve assembly of claim 13 further comprising a pressure gauge in fluid communication with the outer duct.

23. A ducted valve assembly for providing an integrated cryopump valve comprising:

a housing of the assembly having an interface to a cryopump;

a coaxial connection at the interface, connecting to an inner duct and an outer duct of the assembly;

a rough valve connecting the outer duct of the assembly to a rough vacuum pump;

a relief valve connecting the outer duct of the assembly to an exhaust stack;

an exhaust purge valve connecting a nitrogen gas source to the exhaust stack;

a purge valve connecting the nitrogen gas source to the cryopump through the inner duct;

actuators to control the biasing of the purge valve, rough valve and the exhaust purge valve; and a pressure gauge in fluid communication with the outer duct.

* * * * *

UNITED STATES PATENT AND TRADEMARK OFFICE

CERTIFICATE OF CORRECTION

PATENT NO. : 7,194,867 B2
APPLICATION NO. : 10/804842
DATED : March 27, 2007
INVENTOR(S) : Allen J. Bartlett et al.

It is certified that error appears in the above-identified patent and that said Letters Patent is hereby corrected as shown below:

In Claim 7, Column 5, line 13, before “exhaust”, “un” should be --an--;

In Claim 15, Column 6, line 7 before “relief”, “as” should be --is--.

Signed and Sealed this

Fifth Day of June, 2007

JON W. DUDAS
*Director of the United States Patent and Trademark Office*